US009615666B2

(12) United States Patent
Milich et al.

(10) Patent No.: US 9,615,666 B2
(45) **Date of Patent: *Apr. 11, 2017**

(54) BACKPACK ASSEMBLY WITH BACKPACK, FOLDABLE SEAT, AND ROLLERS

(71) Applicant: Let'M Play, LLC, Overland Park, KS (US)

(72) Inventors: Patricia M. Milich, Leawood, KS (US); Michael Milich, Leawood, KS (US); William Manson, Lenexa, KS (US); Brian Jones, Overland Park, KS (US); Renee M. Brobst, Kansas City, MO (US); Diane R. Blanck, Kansas City, MO (US)

(73) Assignee: Let'M Play, LLC, Overland Park, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/145,343

(22) Filed: May 3, 2016

(65) Prior Publication Data

US 2016/0242553 A1 Aug. 25, 2016

Related U.S. Application Data

(63) Continuation of application No. 14/598,967, filed on Jan. 16, 2015, now Pat. No. 9,332,852.

(51) Int. Cl.
*A47C 4/00* (2006.01)
*A47C 1/02* (2006.01)
(Continued)

(52) U.S. Cl.
CPC ..... *A47C 9/10* (2013.01); *A45C 5/146* (2013.01); *A45F 4/02* (2013.01); *A47C 4/28* (2013.01);
(Continued)

(58) Field of Classification Search
CPC .... A47C 4/28; A47C 4/52; A47C 4/24; A47C 9/00; A45F 3/04; A45F 4/02; A45F 2004/026; A45C 2009/002; A45C 7/0063
(Continued)

(56) References Cited

U.S. PATENT DOCUMENTS 4,387,924 A * 6/1983 Fernandez ..... A45C 15/00 224/155
5,527,088 A 6/1996 MacLean
(Continued)

OTHER PUBLICATIONS

Notification of Transmittal of the International Search Report and the Written Opinion of the International Searching Authority, or the Declaration dated May 26, 2016; International Application No. PCT/IB2016/050151; International Filing Date: Jan. 13, 2016; Applicant: Let'M Play, LLC.

*Primary Examiner* — Chi Q Nguyen
(74) *Attorney, Agent, or Firm* — Erise IP, P.A.

(57) ABSTRACT

A backpack assembly that includes a backpack adapted to carry sports equipment with a foldable seat and roller segment secured thereto. The backpack has an internal bag frame to support the sports equipment. The backpack also has a sports-ball-securing segment and an insulated pouch for food and beverages. The foldable seat is secured to the bag frame to provide a seat that can fold out for the participant or spectator to sit upon. The roller segment automatically engages such that the bag can be tipped and rolled by the participant or spectator when the foldable seat is stored. When the foldable seat is deployed, the roller segment automatically disengages to provide a stable platform for the seat.

17 Claims, 8 Drawing Sheets

(51) Int. Cl.

| | |
|---|---|
| ***A47C 9/10*** | (2006.01) |
| ***A47C 13/00*** | (2006.01) |
| ***A47C 4/28*** | (2006.01) |
| ***A45F 4/02*** | (2006.01) |
| ***A47C 4/52*** | (2006.01) |
| ***A45C 5/14*** | (2006.01) |
| *A45C 7/00* | (2006.01) |
| *A45F 3/04* | (2006.01) |
| *A45C 9/00* | (2006.01) |
| *A47C 9/00* | (2006.01) |
| *A47C 7/00* | (2006.01) |
| *A45F 3/10* | (2006.01) |

(52) U.S. Cl.
CPC ..... *A47C 4/52* (2013.01); *A47C 13/00* (2013.01); *A45C 7/0063* (2013.01); *A45C 2009/002* (2013.01); *A45F 3/04* (2013.01); *A45F 3/10* (2013.01); *A45F 2004/026* (2013.01); *A47C 7/00* (2013.01); *A47C 9/00* (2013.01)

(58) Field of Classification Search
USPC .... 297/129, 130, 188.03, 188.13, 188.2, 52, 297/188.06, 188.07, 16.1, 17, 4; 190/8, 190/18 A, 103, 107
See application file for complete search history.

(56) References Cited

U.S. PATENT DOCUMENTS

| | | | | |
|---|---|---|---|---|
| 5,779,112 | A * | 7/1998 | Krulik | A45C 9/00 224/155 |
| 5,927,798 | A * | 7/1999 | Ahn | A45C 15/00 297/129 |
| 5,957,349 | A | 9/1999 | Krulik | |
| 6,048,023 | A * | 4/2000 | Lampton | A45C 15/00 297/129 |
| 6,547,324 | B1 * | 4/2003 | Ammann, Jr. | A47C 4/52 224/155 |
| 6,997,507 | B2 * | 2/2006 | Rhee | A47C 4/48 224/153 |
| 8,573,454 | B2 * | 11/2013 | Talavera Tolentino | A45F 4/02 224/153 |
| 9,332,852 | B1 * | 5/2016 | Milich | A47C 13/00 |
| 2005/0099039 | A1 | 5/2005 | Rhee | |
| 2008/0179358 | A1 * | 7/2008 | Redzisz | A45F 4/02 224/155 |
| 2011/0162931 | A1 * | 7/2011 | Collins | A45C 5/14 190/8 |
| 2012/0067930 | A1 * | 3/2012 | Talavera Tolentino | A45F 4/02 224/155 |

* cited by examiner

BACKPACK ASSEMBLY WITH BACKPACK, FOLDABLE SEAT, AND ROLLERS

RELATED APPLICATIONS

This application is a continuation application and claims priority benefit, with regard to all common subject matter, of earlier-filed U.S. patent application Ser. No. 14/598,967, filed on Jan. 16, 2015, and entitled "BACKPACK ASSEMBLY WITH BACKPACK, FOLDABLE SEAT, AND ROLLERS," which issued as U.S. Pat. No. 9,332,852 on May 10, 2016. The identified earlier-filed patent application is hereby incorporated by reference in its entirety into the present application.

BACKGROUND

1. Field

Embodiments of the invention relate to backpacks and other bags. More specifically, embodiments of the invention relate to a backpack assembly that is a backpack with a foldable seat and rollers attached thereto.

2. Related Art

Children and adults across all demographics play sports for recreation and exercise. Many of these events provide no seating and little space to sit. A solution for players to carry their needed items and be able to sit down is needed. Many of these sports require specialized clothing and equipment. For example, a certain sport may require a ball or disc, a uniform, a special pair of shoes, various padding components, a specialized implement (such as a baseball bat), boundary markers, and safety equipment. The participants may also require personal items such as food, beverages, medication, and inhalers. As such, there is a need for a convenient and efficient method to store and move the personal items and the specialized clothing and equipment from the participant's home to the location of the sport.

Many of these sports are played at recreational facilities, schools, churches, gymnasiums, and parks. Many of these locations do not provide adequate seating for participants and spectators. Some locations provide seating for participants or spectators, but not both. Because seating is usually inadequate, many participants and spectators will bring a seat to sit upon during the game or intermissions. This is yet another item that must be carried by the participant and/or spectator to the location.

Many of these sports are played by children and teenagers, which means that a parent or guardian is often present for the practice and/or game. For instances in which a parent or guardian does not accompany the child (such as an after-school program, for example), the child has difficulty carrying the personal items, specialized clothing and equipment, and the seat. Even if present, the parent or guardian may also have difficulty carrying the equipment.

The prior art fails to provide a solution to these problems. Most backpacks or other bags of the prior art do not provide a foldable seat for the convenience of the user, requiring the user to carry or strap on a seat. This solution is difficult, time-consuming, and prone to loss. Some seats of the prior art provide attached bags and compartments, but these bags are often too small and not adapted for carrying sports equipment. Also, some backpacks provide rollers for ease of use by the user, but the rollers are permanently positioned, such that the backpack does not provide a stable base for sitting upon.

SUMMARY

Embodiments of the invention solve the above-mentioned problems by providing a backpack assembly that includes a backpack adapted to carry sports equipment with a foldable seat and a roller segment secured thereto. The backpack has an internal bag frame to support the sports equipment. The backpack also has a sports-ball-securing segment and an insulated pouch for food and beverages. The foldable seat is secured to the bag frame to provide a seat that can fold out for the participant or spectator to sit upon. The backpack assembly transitions between the backpack mode and chair mode in one simple motion. The roller segment automatically engages such that the bag can be tipped and rolled by the participant or spectator when the foldable seat is stored. When the foldable seat is deployed, the roller segment automatically disengages to provide a stable platform for the seat.

Embodiments of the invention are directed to the backpack assembly. In some embodiments, the backpack assembly comprises the backpack, the foldable seat, and the roller segment. In other embodiments, the backpack assembly comprises the backpack and the foldable seat, with no roller segment. In still other embodiments, the backpack assembly comprises a bag frame and the foldable seat, so the user can attach a backpack thereto. In yet further embodiments, the backpack assembly comprises the backpack, the foldable seat, and the roller segment, but the backpack is not specifically adapted to carrying sports equipment.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
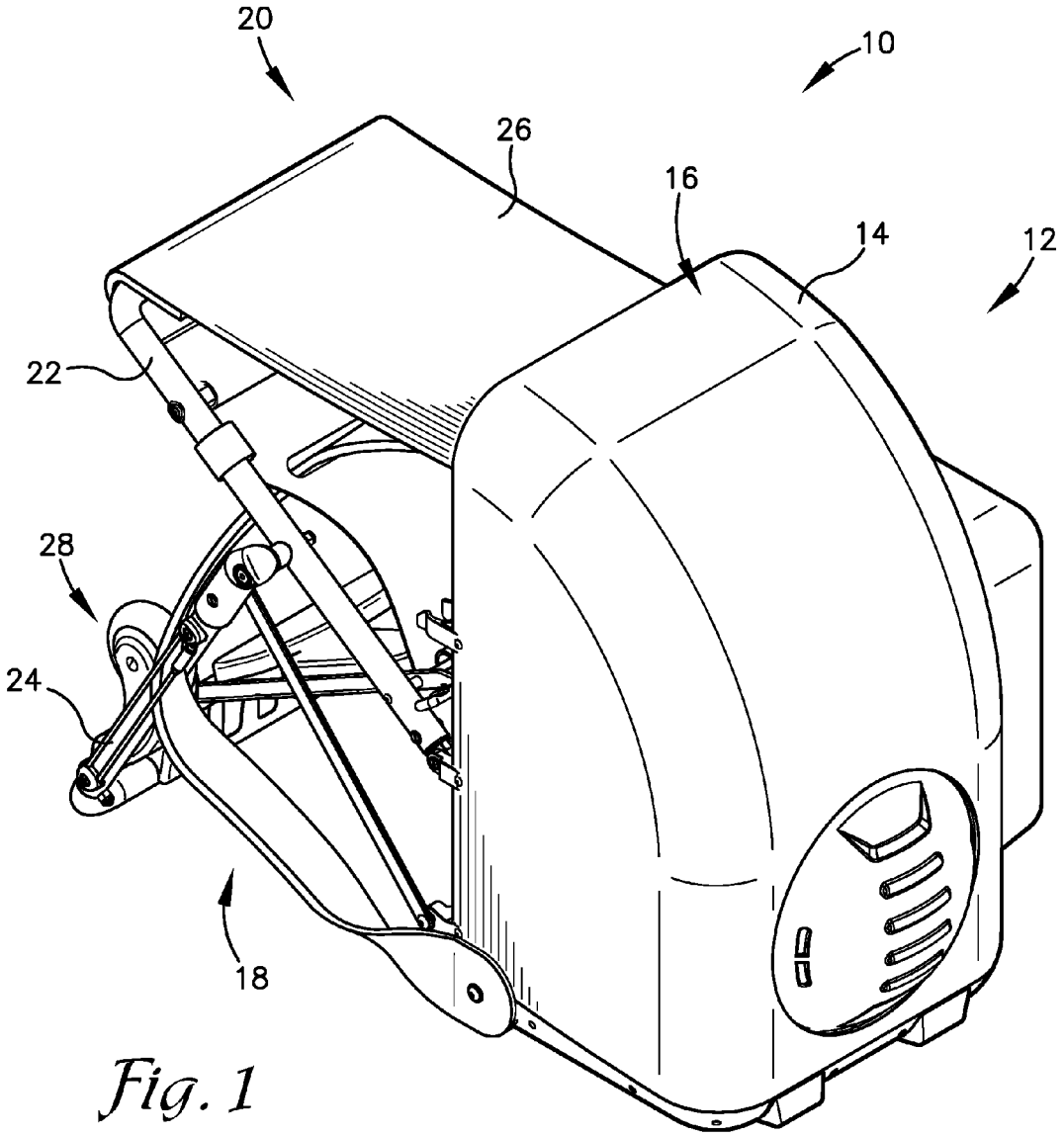
FIG. 1 is a perspective view of one embodiment of the backpack assembly in the sitting position, as viewed from a front, top, and left side.

The drawing figures do not limit embodiments the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, embodiments of the invention can include a variety of combinations and/or integrations of the embodiments described herein.

Turning to the Figures, and specifically FIG. 1, embodiments of the invention comprise a backpack assembly 10. The backpack assembly 10 comprises a backpack 12 that includes a compressible bag 14, a bag frame 16, and a pair of flexible straps 18; a foldable seat 20 that includes an upper support 22, a lower support 24, and a flexible sheet 26; and a roller segment 28. The components of the backpack assembly 10 are discussed in much more detail below. Although embodiments of the invention are described with respect to a backpack assembly for wearing on a user's back, embodiments of the invention may also be applicable to any bag having an integrated seat as described herein.

Figure 5:
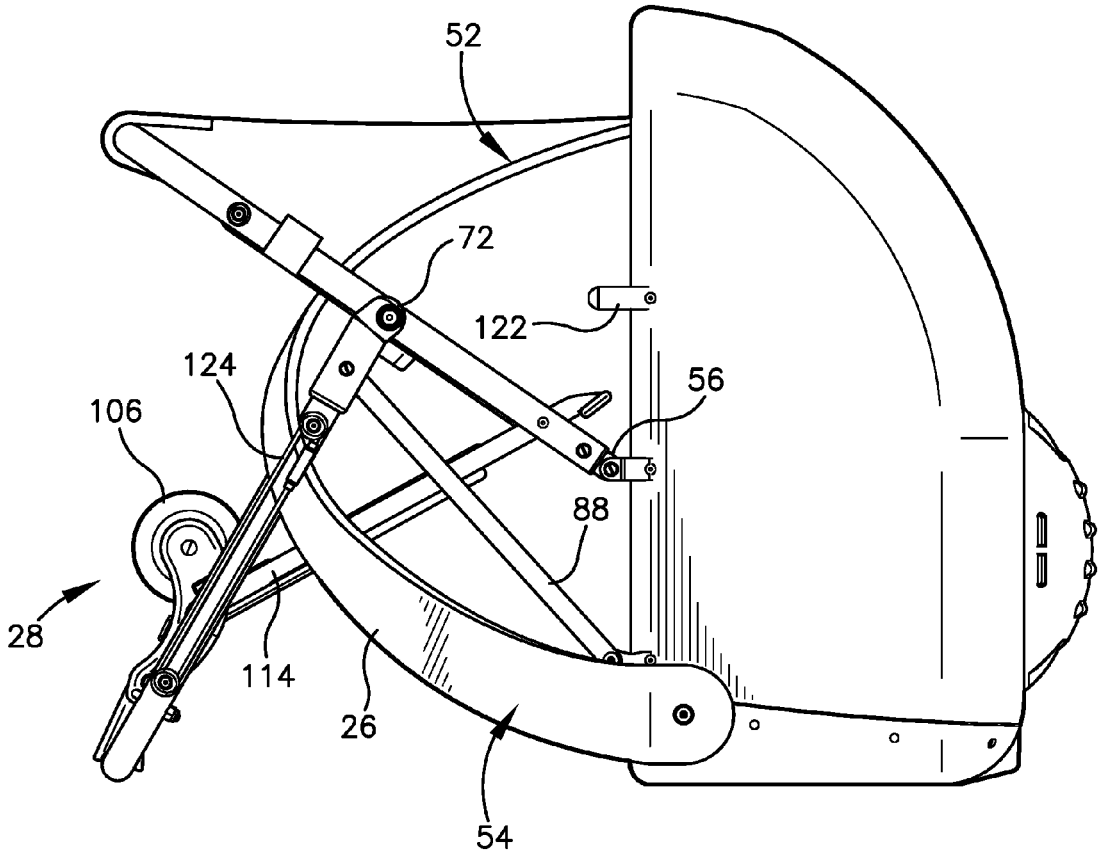
FIG. 5 is a left side view of the backpack assembly of FIG. 1.
Figure 6:
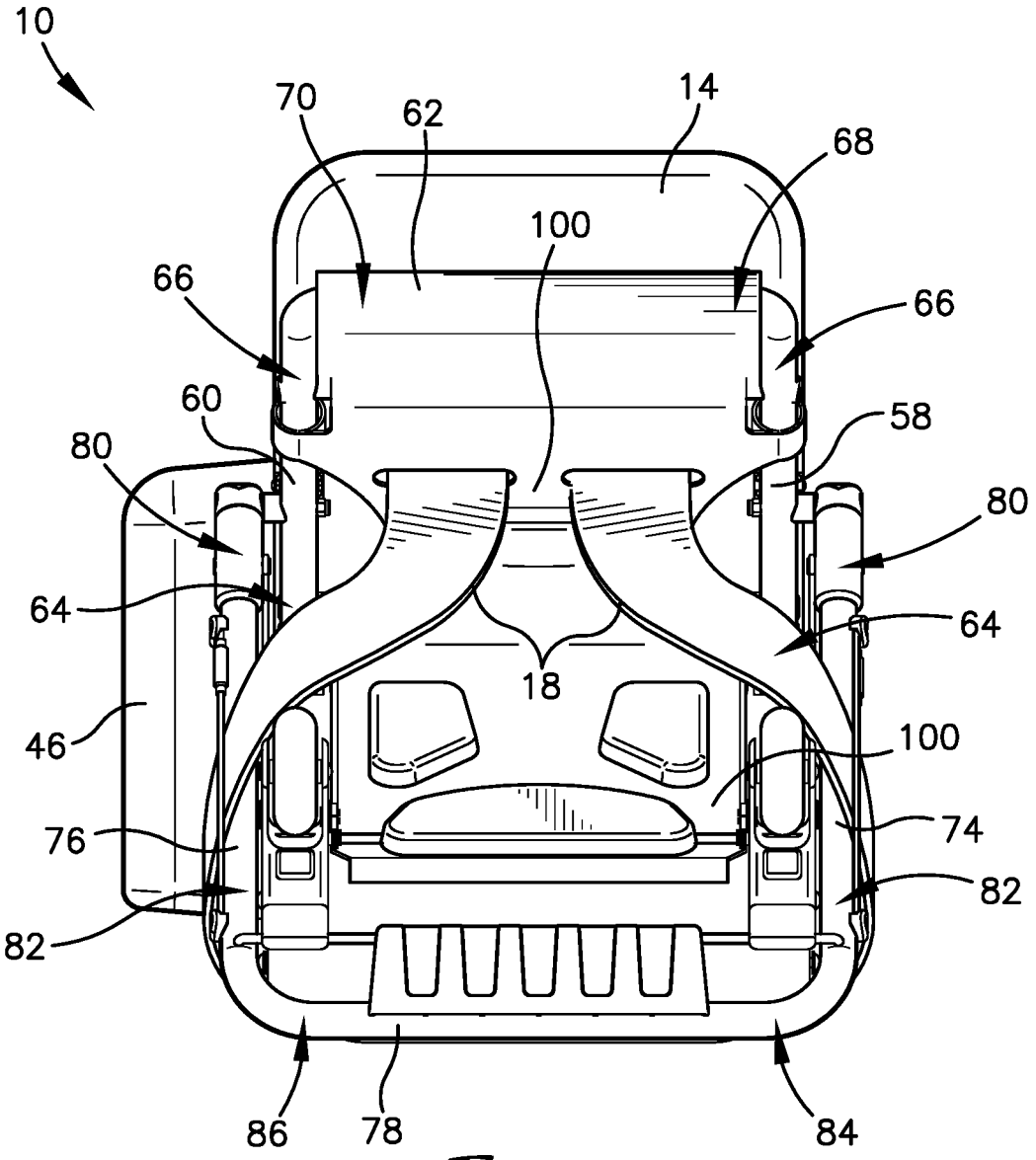
FIG. 6 is a back side view of the backpack assembly of FIG. 1, specifically illustrating the foldable seat.
Figure 7:
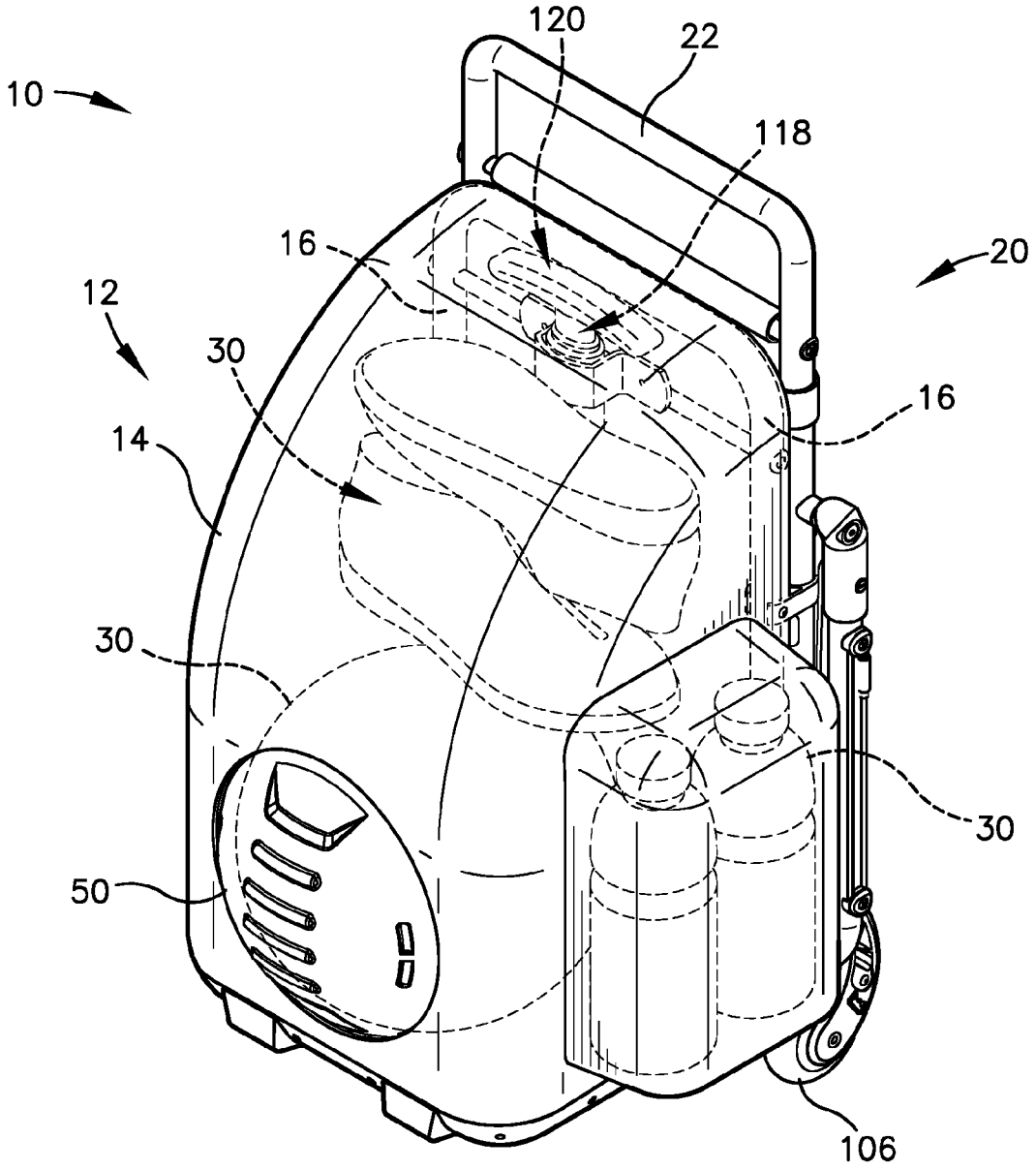
FIG. 7 is a perspective view of the backpack assembly of FIG. 1 in the carrying position and depicting exemplary contents of the backpack, as viewed from a front, right side.
Figure 8:
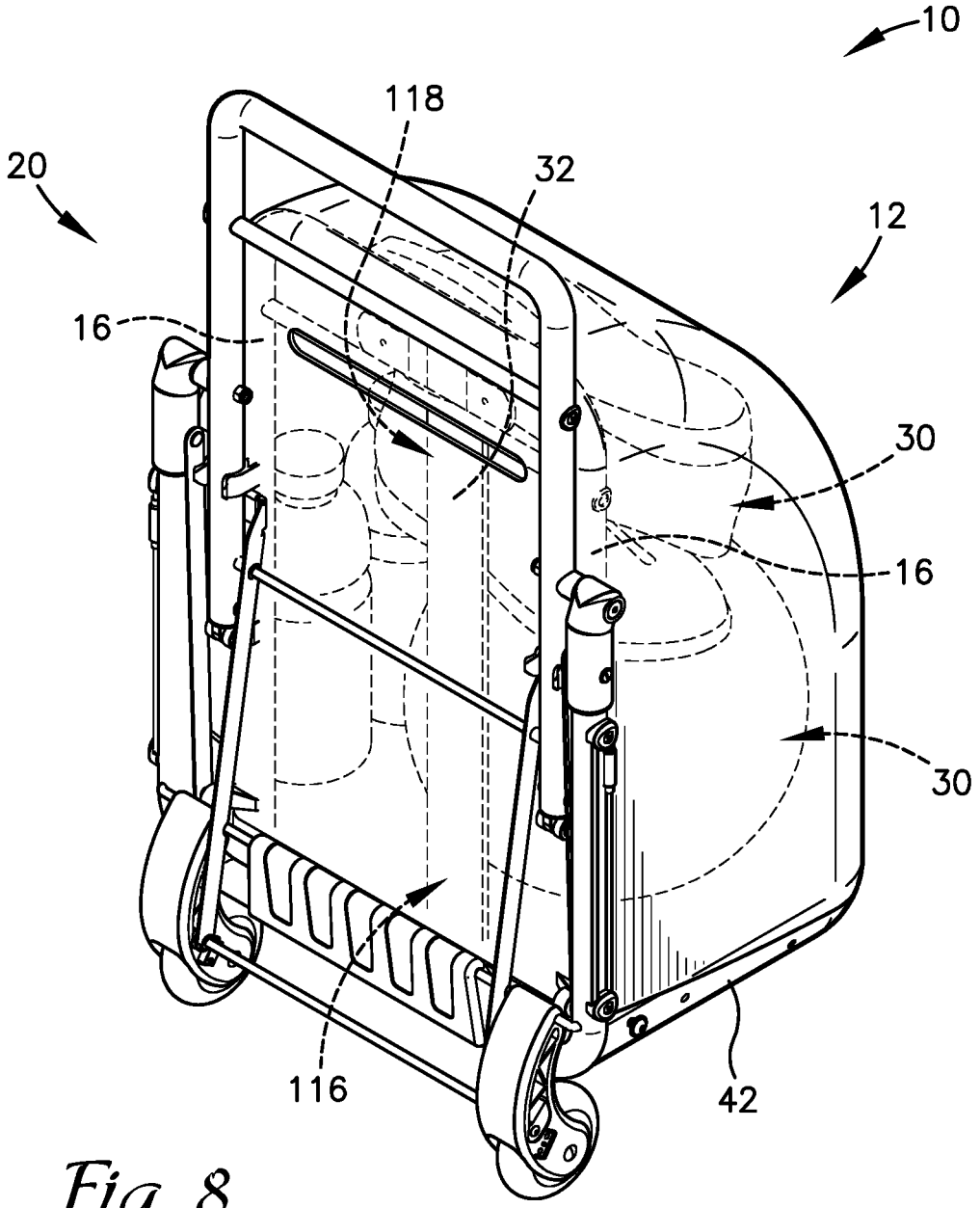
FIG. 8 is a perspective view of the backpack assembly of FIG. 7, as viewed from a back, left side.

The backpack assembly 10 is generally adapted to carry sports equipment 30 (or other equipment discussed below) for a user. This provides convenience for the user because a set of their sports equipment 30 remains in the backpack assembly 10 and transported to an activity location. The user positions the backpack assembly 10 from a carrying position (as illustrated in FIGS. 1-6, in which the foldable seat 20 is stored) to a sitting position (as illustrated in FIGS. 7-8, in which the foldable seat 20 is deployed). The user may then sit upon the foldable seat 20.

As discussed above, the backpack assembly 10 is adapted to carrying the necessary specialized equipment and clothing for the sport. Some backpack assemblies 10 may therefore be adapted to a particular sport, such as soccer, football, or tennis. Other backpack assemblies 10 may be adapted to generic sports. This specialized equipment for which the backpack assembly 10 may be adapted include sports balls, or other game devices, such as soccer balls, baseballs, softballs, footballs, tennis balls, discs, pucks, etc.; specialized game implements, such as baseball bats, tennis rackets, lacrosse sticks, jai alai cestas, ice skates, inline skates, cleats, etc.; and specialized safety equipment, such as bicycle helmets, football helmets and pads, baseball catcher's equipment, shin guards, face masks, rock climbing harnesses and rope, etc. The backpack assembly 10 may be adapted to hold the specialized equipment by presenting a certain pocket, opening, compartment, strap, clip, carabiner, or other retaining device of a size and shape to accommodate the specialized equipment.

While this disclosure focuses on embodiments of the invention directed to sports, other embodiments of the invention may be directed to other fields and uses. The sports applications are therefore only an exemplary field for the invention. Other fields and uses will be briefly discussed; however, it should be appreciated that the invention could be applied to fields and uses beyond those discussed. Some of the other fields and uses could include the following: traveling, camping, hunting, fishing, military, construction, education, outdoor events, boating, business, gardening, farming, amusement parks, spectator seating, etc.

Some embodiments of the invention are directed to the field of luggage and travel. Travelers spend long periods of time inside airports, bus stations, train stations, etc. Many of these locations are busy and provide inadequate seating for the number of travelers present during peak times. The backpack assembly 10 provides a seat for a user that is traveling so that the user is not forced to sit on the floor or stand for long periods of time. The backpack assembly 10 may also adapted for traveling by, for example, being of a suitable size and dimensions to fit into an aircraft's overhead bin.

Some embodiments of the invention are directed to the fields of camping, hunting, and fishing. While camping, hunting, or fishing, the user must carry a significant amount of equipment to a remote location. The user then remains at this remote location for several hours or days. The backpack assembly 10 provides a convenient seat for the user to utilize at the remote location, and is adapted to carry the specialized equipment such as firearms, ammunition, tackle boxes, fishing poles, knives, tents, sleeping bags, food, water, etc.

Some embodiments of the invention are directed to the field of the military. Military personnel perform numerous tasks while in remote locations. For example, a forward observer observes artillery and mortar fire from an observation post. The forward observer must carry a significant amount of specialized equipment for observing and calling-for fire, and must have a stable and comfortable place to sit for the observations. As another example, a security guard may carry equipment to a remote location, such as the top of a building, to observe activity. As yet another example, military staff must perform administrative and logistical tasks, such as performed on a laptop computer, from any remote location. The backpack assembly 10 of embodiments is adapted to meet these needs.

Some embodiments of the invention are directed to the field of construction. A construction worker must bring specialized tools to the work site such as saws, hammers, wrenches, air-powered tools, electrically-powered tools, etc. Many work sites do not provide a seat for breaks or certain tasks that can or must be performed from the seated position. The backpack assembly 10 of one embodiment is adapted to meet this need. For example, the backpack assembly 10 may include an internal power pack or air compressor for powering the tools.

The components of the backpack assembly 10, as briefly introduced above, will now be discussed. As noted above, the backpack assembly 10 comprises the backpack 12, the foldable seat 20, and the roller segment 28. The backpack 12 provides at least one pocket in which the user can store the sports equipment 30, with one or more pockets or compartments being adapted for the specialized equipment for that sport. The foldable seat 20 is permanently and deployably secured to the bag frame 16 of the backpack 12. In embodiments of the invention, when the backpack assembly 10 is in a carrying position, the foldable seat 20 is substantially parallel with, and adjacent to, the bag frame 16. The user may then place the backpack assembly 10 on his back (such that the folded foldable seat 20 is adjacent to his back) or tip the backpack assembly 10 and maneuver it via the roller segment 28 and a telescoping handle 32, discussed below. When the backpack assembly 10 is in a sitting position, the foldable seat 20 is pivoted away from its substantially parallel orientation to an angled orientation that presents a general K-shape, as illustrated in FIG. 5.

Figure 2:
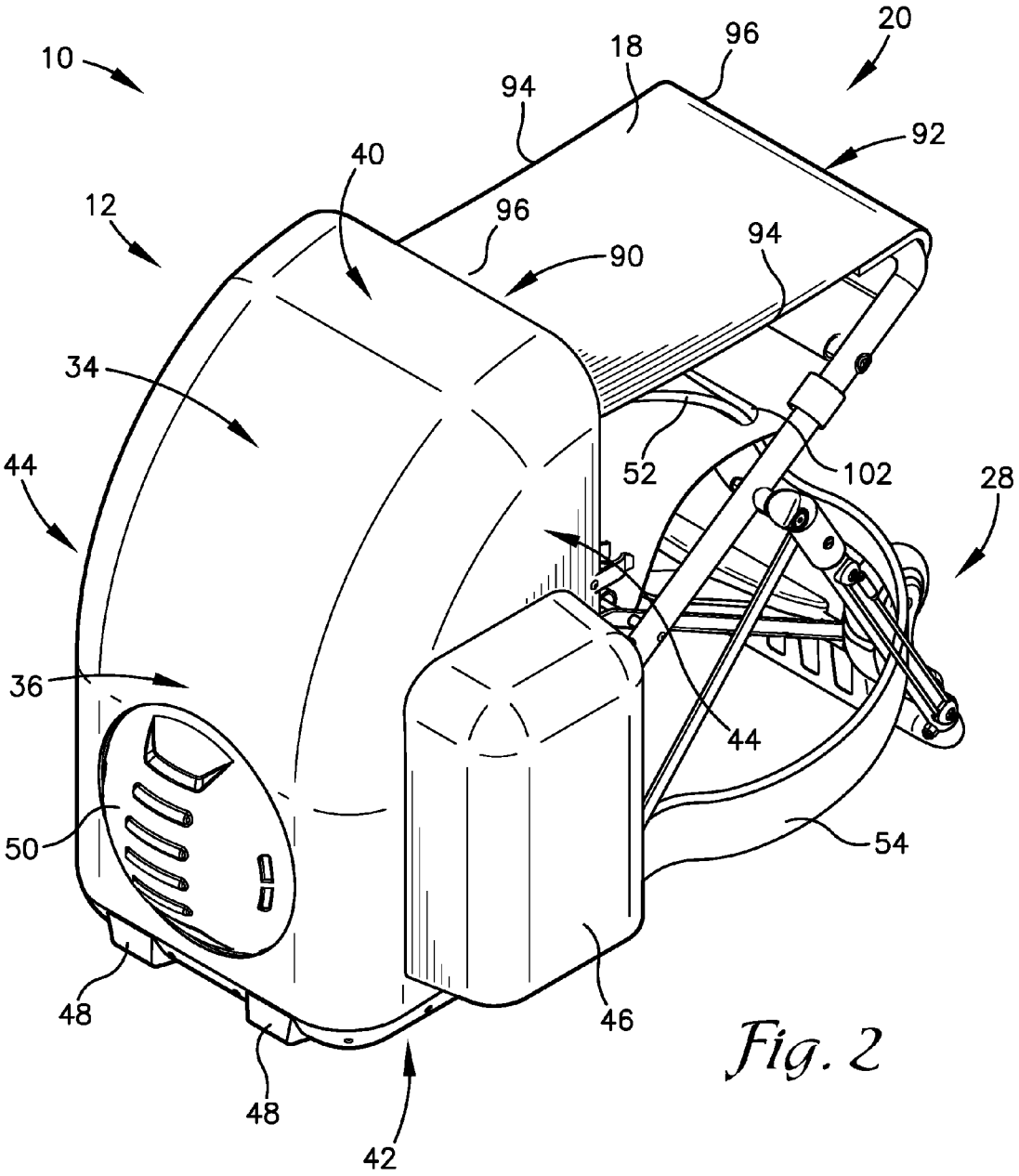
FIG. 2 is a perspective view of the backpack assembly of FIG. 1, as viewed from a front, top, and right side.
Figure 3:
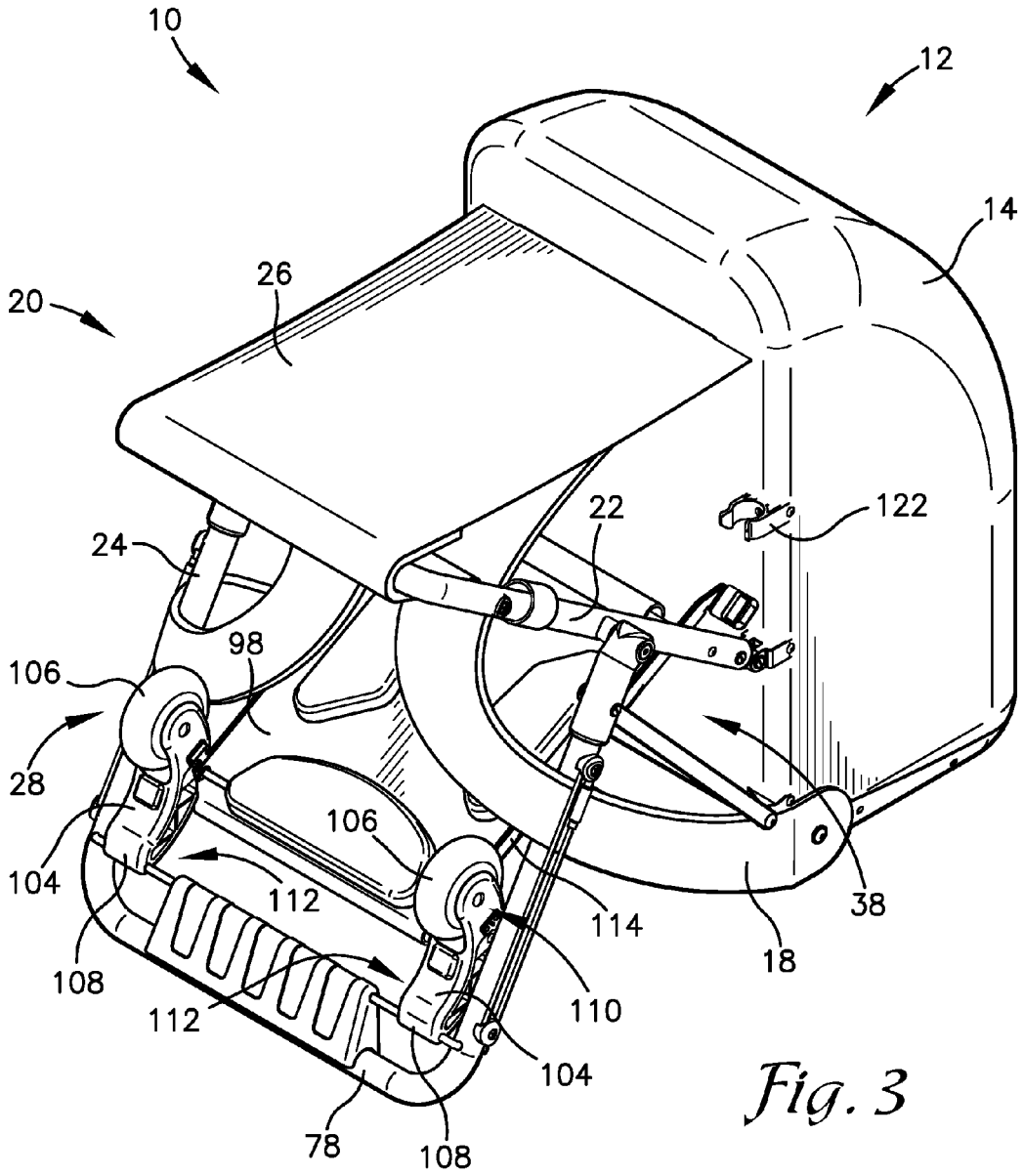
FIG. 3 is a perspective view of the backpack assembly of FIG. 1, as viewed from a back, top, and left side.

As best illustrated in FIGS. 1 and 2, the backpack 12 of the backpack assembly 10 comprises the compressible bag 14, the bag frame 16, and the pair of flexible straps 18. The compressible bag 14 provides a main compartment 34 for the storing of sports equipment 30. The bag frame 16 provides rigidity to the backpack 12, provides stability for a user sitting upon the foldable seat 20, and prevents the contents of the compressible bag from pressing against the user's back. The pair of flexible straps 18 allows the user to easily carry the backpack 12.

The compressible bag 14 is generally oriented in a vertical direction. The compressible bag 14 presents a front segment 36, a back segment 38, a top segment 40, a bottom segment 42, and two side segments 44. The sports equipment 30 (or other items) is stored in the interior of the backpack 12. An interior of the compressible bag 14 may comprise the main compartment 34 and at least one secondary compartment 46 (which may be within the main compartment 34, exterior to the main compartment 34, or both). The interior can be accessed through any number of openings. The openings may be secured via zippers, clasps, hook and pile tape, strings, elastic, snaps, etc.

The compressible bag 14 is formed of a flexible material, such as canvas, cotton duck, cotton, polyester, nylon, ballistic nylon, cordura, other fabric, or a combination thereof. At least a portion of the compressible bag 14 may be reinforced with a durable material, such as a polymer or a metal. Portions of the compressible bag 14 may be rigid or semi-rigid, as discussed below, and may be formed of a plastic or other polymer. While the bag is compressible, it substantially keeps its shape due to the bag frame 16 and the rigid or semi-rigid portions discussed below.

Figure 4:
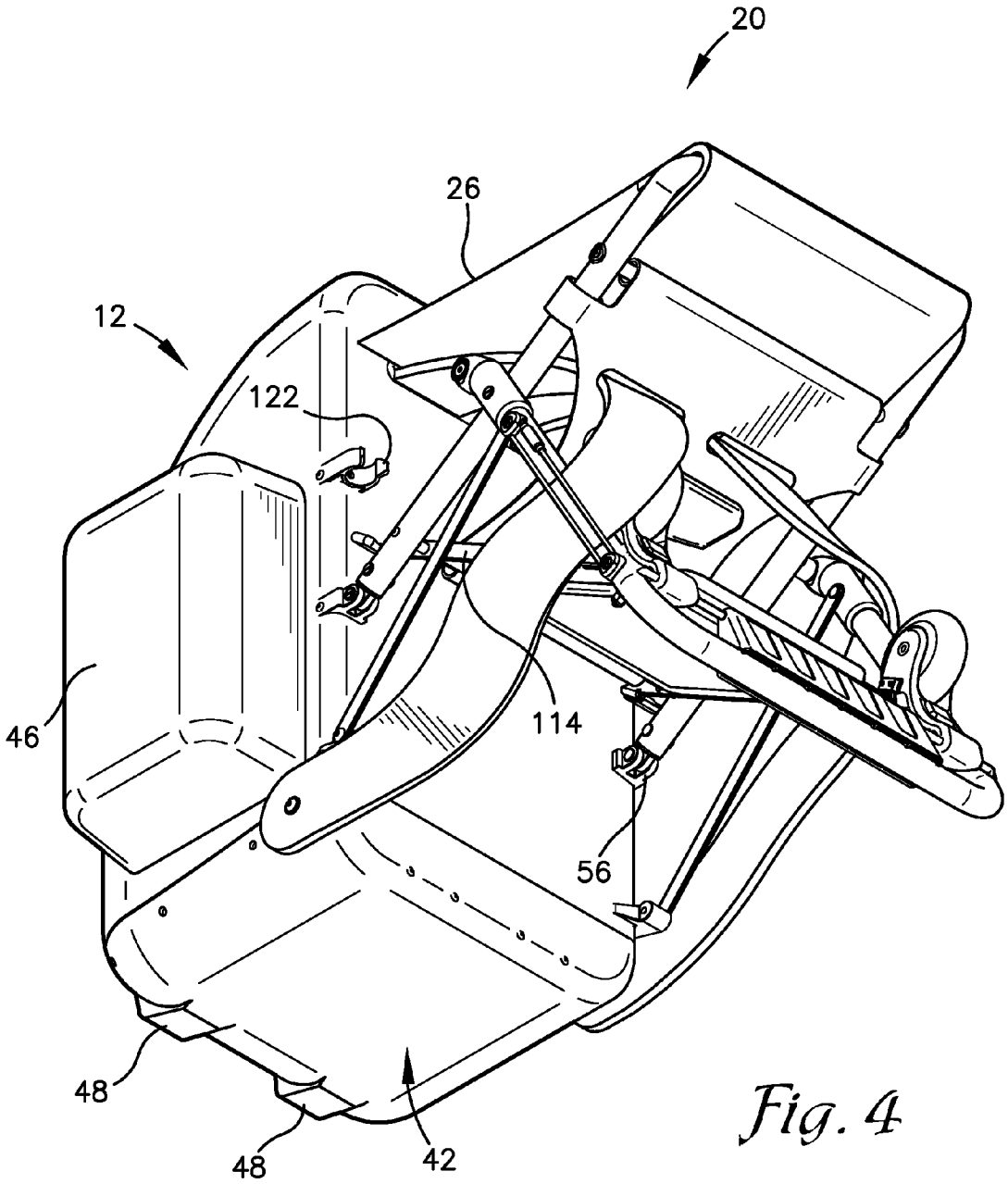
FIG. 4 is a perspective view of the backpack assembly of FIG. 1, as viewed from a back, bottom, and right side.

As best illustrated in FIG. 4, in some embodiments the bottom segment 42 of the compressible bag 14 is substantially rigid. The substantially rigid bottom segment 42 aids in the compressible bag 14 keeping its shape and provides a steady base when the backpack assembly 10 is in the sitting position. The substantially rigid bottom segment 42 also prevents or reduces damage to the bottom segment 42 of the compressible bag 14. The substantially rigid bottom segment 42 may be formed of a hardened plastic or other polymer, or may be formed of a metal. In some embodiments, only a portion of the bottom segment 42 is substantially rigid. In yet other embodiments, none of the bottom segment 42 is substantially rigid, instead a portion of the bag frame 16 extends beyond the bottom segment 42 to provide a stable base for the foldable seat 20. The rigid bottom segment may present rounded or arcuate sides. The rigid bottom segment may also present stabilizer segments 48 to prevent the backpack assembly 10 from tipping. The rigid bottom segment may also be secured to the bag frame 16, as discussed below. In some embodiments of the invention, the rigid bottom segment hinges for collapsible storage of the backpack assembly 10 (not illustrated). The hinge may be located at or near the bag frame 16 and be adapted to pivot upwards.

Some embodiments of the backpack 12 include a sports-ball-securing segment 50, as best illustrated in FIGS. 1, 2, 5, and 7. The sports-ball-securing segment 50 is specially adapted to secure a sports ball, such as a soccer ball, basketball, or football. The sports-ball-securing segment 50 is a compartment of the interior of the compressible bag 14 that is separate from, but adjacent to, the main compartment 34. There may be at least one additional divider (not illustrated) to retain the contents of the sports-ball-securing segment 50 separate from the contents of the main compartment 34. The sports-ball-securing segment 50, in one embodiment, is located on the front segment 36 of the compressible bag 14. The sports-ball-securing segment 50 prevents a portion of the sports ball from occupying the space in the main compartment 34. The sports-ball-securing segment 50 also provides quick and easy access to the sports ball, instead of requiring the user to dig the sports ball out of the bottom of the main compartment 34 (where it might otherwise be). In other embodiments of the invention, the sports-ball-securing segment 50 may be adapted to secure any of the specialized equipment discussed herein, or their equivalents. For example, a binocular-securing segment (not illustrated) may be adapted to securely hold binoculars for a hunter or military service member and allows them to be quickly accessed from the exterior of the compressible bag 14. As another example, a hammer-securing segment (not illustrated) may be adapted to securely hold a hammer for a construction worker.

The sports-ball-securing segment 50 may present a semi-rigid shape. The semi-rigid shape is complementary to the shape of the sports ball. In one embodiment as illustrated in FIGS. 2 and 7, the sports-ball-securing segment 50, which is adapted for a soccer ball, may present a semi-rigid dome on the exterior of the front segment 36 of the compressible bag 14. The soccer ball has a similar circumference to that of the dome, such that the soccer ball fits into the interior of the dome in a substantially complementary way. In another embodiment, the dome is of a similar size and shape as a basketball. In yet another embodiment, the sports-ball-securing segment 50 is adapted for a football (not illustrated) and presents a semi-rigid cone in lieu of the dome.

In some embodiments of the compressible bag 14, at least one of the secondary compartments 46 is insulated, as illustrated in FIGS. 2 and 7. This secondary compartment 46 is adapted to receive and hold food items and/or drink items for the user. This secondary compartment 46 provides thermal insulation to keep the food and/or drink items cold or hot. This secondary compartment 46 may be located externally to the main compartment 34, as illustrated in FIG. 2, for quick access by the user. In other embodiments, the insulated secondary compartment 46 is internal to the main compartment 34. In still other embodiments, such as a backpack assembly 10 adapted to be a rolling cooler with a seat, the main compartment 34 is insulated and the secondary compartments 46 are not insulated.

In some embodiments of the invention, the backpack 12 presents at least one individualized nametape (not illustrated) on the exterior. The individualized nametape may be originally manufactured on the backpack 12 and/or it may be selectively removable via hook and pile tape (also known as VELCRO) or a zipper. The individualized nametape may also include team names, logos, mascots, school names, etc. The individualized nametape identifies the owner of the backpack assembly 10 and/or the team for which they play for quick and easy recognition and to display team spirit. In one embodiment, a first individualized nametape is removably secured to the back segment 38 of the compressible bag 14 via hook and pile tape and a second individualized nametape removably secured to the front segment 36 of the compressible bag 14 via two zippers.

Embodiments of the backpack 12 comprise two flexible straps 18. The flexible straps 18 provide a convenient carrying handle for the user to carry the backpack 12. Each flexible strap 18 presents a top end 52 and a bottom end 54. The top end 52 is secured to the back segment 38 near the top segment of the backpack 12. The bottom end 54 is secured to the side segment 44 near the bottom segment. In other embodiments, the top end 52 may be secured to the side segment 44 near the top segment, or to the top segment. In other segments, the bottom end 54 may be secured to the back segment 38 near the bottom segment, or to the bottom segment. The top end 52 of each flexible strap 18 may also be secured to the top end 52 of the other flexible strap 18, such that there is a single attachment point for the two top ends 52 of the flexible straps 18.

In some embodiments, each top end 52 of the flexible straps 18 is separable from the bottom end 54 by releasing a middle securing segment (not illustrated). The middle securing segment of each flexible strap 18 may be secured by a hook and pile tape. This provides the advantage of making the flexible strap 18 quick and easy to remove. In other embodiments, the flexible strap 18 is selectively removable from the backpack 12.

In some embodiments, each flexible strap 18 presents a length that is adjustable. The length may be adjusted by reducing the length of the lower end via a standard plastic strap adjuster. In other embodiments, not illustrated, there is a single flexible strap 18 for carrying the backpack 12 in the manner of a messenger bag or purse. In still other embodiments, not illustrated, the flexible straps 18 are similar to those of a duffel bag, including two hand-gripping straps secured to the top segment 40 of the backpack. In yet other embodiments, there are no flexible straps and the backpack 12 is moved exclusively via the roller segment 28 discussed below or via a handle.

The bag frame 16 provides structure and stability to the backpack 12, and is best illustrated in FIG. 8. The bag frame 16 is rigid structure that is located at least partially within the backpack 12. The bag frame 16 may be formed of a metal, such as aluminum, or a polymer, such as plastic. The bag frame 16 is generally rectangular in shape, and may present arcuate corners. The bag frame 16 is oriented vertically, such that the backpack 12 is also generally oriented vertically. The bag frame 16 acts as a seat support when the backpack assembly 10 is in the sitting position. The bag frame 16 therefore provides structural support for the foldable seat 20. In other embodiments, the bag frame 16 is external to the backpack 12.

The foldable seat 20 will now be discussed. The foldable seat 20 provides the user with an available seat wherever the user is with the backpack assembly 10. The foldable seat 20 is therefore sturdy enough to support an adult person, for example up to 300 pounds. The user need not remember to bring a seat because the foldable seat 20 is secured to their backpack assembly 10. The foldable seat 20 is adapted to be in two positions: the carrying position, and the sitting position. When in the carrying position, the foldable seat 20 is folded (i.e., not deployed or engaged) substantially vertically, such that the backpack assembly 10 can be easily stored and carried on the user's back, arms, and/or shoulders. The various components of the foldable seat 20 are each substantially parallel and adjacent to each other. When in the sitting position, the foldable seat 20 is unfolded (i.e., deployed and engaged) in a substantial K-shape, as discussed below, such that the user can sit upon the foldable seat 20. In other embodiments, the foldable seat 20 in unfolded into another shape, such as an X-shape, tripod, etc.

In embodiments of the invention, the foldable seat 20 is pivotably and permanently secured to bag frame 16 of the backpack 12. The foldable seat 20 comprises the upper support 22, the lower support 24, and the flexible sheet 26. As best illustrated in FIGS. 6 and 8, the upper support 22 and the lower support 24 provide structural stability for the flexible sheet 26, upon which the user sits when the backpack assembly 10 is in the sitting position. Both the upper support 22 and the lower support 24 present a cross-sectional shape adapted to carry the load. In various embodiments of the invention, the cross-sectional shape may be circular, elliptical, square, rectangular, triangular, or other shape. In one embodiment, the upper support 22 and the lower support 24 each present a complementary shape at cross-section such that they interfit together to present a small, compact envelope when the backpack assembly 10 is in the carrying position. Both the upper support 22 and the lower support 24 may be formed of a metal, such as aluminum, or a polymer, such as plastic. The upper support 22, lower support 24, and bag frame 16 may all be formed of the same material. In other embodiments of the invention, the foldable seat 20 is selectively removable by the user, such that the user can remove the foldable seat 20 if it is not needed.

The upper support 22 is rigid so as to support a portion of the weight of the user. The upper support 22 is pivotably secured to the bag frame 16. There may be an opening in the back segment 38 of the compressible bag 14 to allow at least one upper-support interface 56 of the bag frame 16 to be disposed externally to the backpack 12 so that the upper support 22 may be pivotably secured thereto. The upper support 22 is oriented in a generally upward direction from the upper-support interface 56.

Referring to FIG. 6, in embodiments of the invention, the upper support 22 is generally U-shaped so as to present a first upper arm 58, a second upper arm 60, and an upper traversing segment 62, which is primarily covered in FIG. 6 by the seat. Each of the first upper arm 58 and the second upper arm 60 presents a distal end 64 and a proximal end 66. The upper traversing segment 62 presents a first end 68 and a second end 70. The distal end 64 of the first upper arm 58 is pivotably attached to the upper-support interface 56 of the bag frame 16. The proximal end 66 of the first upper arm 58 is secured or otherwise integrally formed to the first end 68 of the upper traversing segment 62. The distal end 64 of the second upper arm 60 is pivotably secured to another of the upper-support interfaces 56. The proximal end 66 of the second upper arm 60 is secured or otherwise integrally formed to the second end 70 of the upper traversing segment 62. Therefore, the first upper arm 58, the second upper arm 60, and the upper traversing segment 62 form a general U-shape. The 'top' of the U-shape is pivotably secured to the two upper support 22 interfaces of the bag frame 16. The transitions between the upper traversing segment 62 and the respective arm may be rounded or arcuate, as illustrated in FIG. 6. In other embodiments, the upper support 22 is substantially V-shaped, rectangular, square, elliptical, triangular, or other shape.

The lower support 24 is also rigid so as to support a portion of the weight of the user. The upper support 22 is pivotably secured to top segment 40. The top segment 40 therefore presents a lower-support interface 72. The lower support 24 is oriented in a generally downward direction from the lower-support interface 72.

In embodiments of the invention, the lower support 24 is generally U-shaped so as to present a first lower arm 74, a second lower arm 76, and a lower traversing segment 78. Each of the first lower arm 74 and the second lower arm 76 present a distal end 80 and a proximal end 82. The lower traversing segment 78 presents a first end 84 and a second end 86. The distal end 80 of the first lower arm 74 is pivotably attached to the lower-support interface 72 of the upper support 22. The proximal end 82 of the first lower arm 74 is secured or otherwise integrally formed to the first end 84 of the lower traversing segment 78. The distal end 80 of the second lower arm 76 is pivotably secured to another of the lower-support interfaces 72. The proximal end 82 of the second lower arm 76 is secured or otherwise integrally formed to the second end 86 of the lower traversing segment 78. Therefore, the first lower arm 74, the second lower arm 76, and the lower traversing segment 78 form a general U-shape. The transitions between the lower traversing segment 78 and the respective arm may be rounded or arcuate, as illustrated in FIG. 6. In other embodiments, the lower support 24 is substantially V-shaped, rectangular, square, circular, or other shape.

As viewed from the side as illustrated in FIG. 5, the bag frame 16, the upper support 22, and the lower support 24 form a general K-shape when the backpack assembly 10 is in the sitting position. There are therefore two relevant angles in the K-shape, relative to the substantially vertical bag frame 16. The first angle is the angle between the bag frame 16 and the upper support 22. The first angle may be more than 80 degrees, 10-80 degrees, 20-70 degrees, 30-60 degrees, 40-50 degrees, etc. The second angle is the angle between the upper support 22 and the lower support 24. The second angle may be 40-140 degrees, 60-120 degrees, 80-100 degrees, etc. In some embodiments, the first angle and/or the second angle are adjustable so as to alter the height of the adjustable seat.

In some embodiments of the invention, not illustrated, the lower support 24 is pivotably attached to the bag frame 16, and the upper support 22 is pivotably attached to the lower support 24. As such, the bag frame 16, the upper support 22, and the lower support 24 for an upside-down K-shape when viewed from the side. In yet other embodiments, not illustrated, the upper support 22 and the lower support 24 are secured to each other near the center of their respective first arms and second arms, and either the upper support 22 or the lower support 24 is also pivotably secured to the bag frame 16.

In some embodiments of the invention, two secondary lower support bars 88 are pivotably attached to the lower support 24 and to the bag frame 16. The two secondary lower support bars 88 ensure that the two respective arms 74, 76 of the lower support 24 remain parallel to the bag frame 16. The two secondary lower support bars 88 also provide additional support to the user sitting upon the foldable seat 20.

The flexible sheet 26 is the portion of the foldable seat 20 upon which the user sits when the backpack assembly 10 is in the sitting position. The flexible sheet 26 is connected at a proximal end 90 to the backpack 12 and/or the bag frame 16. The flexible sheet 26 is connected at a distal end 92 to the upper support 22. In some embodiments, the flexible sheet 26 at least in part covers the upper support 22. The flexible sheet 26 covers the upper support 22 and is secured to another portion of itself and/or the cushion described below. When the backpack assembly 10 is in the sitting position, the flexible sheet 26 is pulled tight, or substantially tight, between the upper support 22 and the backpack 12/bag frame 16, so as to support at least a portion of the weight of the user sitting upon the flexible sheet 26 of the foldable seat 20.

The flexible sheet 26 is generally rectangular so as to present two long sides 94 and two short sides 96. One of the short sides 96 is supported along its length by the backpack 12 and/or the bag frame 16. The other short side 96 is supported along its length by the upper support 22. The two long sides 94 are not directly supported. Therefore, as the user sits on the flexible sheet 26, the two long sides 94 bow or bend beneath the weight of the user, but provide a stable seat. However, it should be appreciated that in one embodiment the flexible sheet 26 is substantially square such that the long sides 94 and short sides 96 present substantially the same length. In other embodiments, the flexible sheet 26 is another shape, such as a triangle or an oval.

In some embodiments of the invention, the foldable seat 20 further includes a carrying cushion 98. The carrying cushion 98 is disposed within an interior of the U-shaped upper support 22, the U-shaped lower support 24, or both. When the backpack assembly 10 is in the carrying position, the carrying cushion 98 is positioned against the user's back. Some embodiments of the carrying cushion 98 also prevent the lower traversing segment 78 from being directly against lower back.

In embodiments of the invention, the carrying cushion 98 comprises a plurality of cushion segments 100. At least one cushioning segment is disposed on the upper support 22 and at least one cushioning segment is disposed on the lower support 24. As the backpack assembly 10 is selectively positioned by the user into the carrying position and the sitting position, the at least one cushioning segment remains parallel to and disposed on its respective upper or lower support 22, 24. When the backpack assembly 10 is in the carrying position, and the upper support 22 and lower support 24 are therefore substantially parallel, the plurality of cushioning segments are substantially planar. When the backpack assembly 10 is in the sitting position, and the upper support 22 and lower support 24 are presenting the second angle (discussed above), at least one of the cushion segments 100 is at an angle relative to at least one other cushion segment 100 that is substantially similar to the second angle. Positioning the carrying cushion 98 on the foldable seat 20, instead of directly on the backpack 12, provides a space between the carrying cushion 98 and the back segment 38 of the compressible bag 14. The space allows the carrying cushion 98 to flex and conform to the shape of the user's back.

In some embodiments, the carrying cushion 98 presents a pair of openings 102 for the flexible straps 18. Because the flexible straps 18 must pass from back segment 38 near the top segment to the side segment 44 near the bottom segment, the flexible straps 18 of some embodiments pass through at least a portion of the carrying cushion 98. Each of the pair of openings 102 is elongated and of a substantially similar shape as a horizontal cross-sectional shape of the flexible strap 18. In other embodiments, the flexible straps 18 pass around the carrying cushion 98 instead of through it. In some embodiments, the carrying cushion 98 is disposed on the backpack 12 in lieu of being disposed on the foldable seat 20.

In some embodiments of the invention, the foldable seat 20 further includes at least one cushion support bar for the carrying cushion 98. In one embodiment, a lower cushion support bar traverses between two roller arms 104, as discussed below, to cause the roller segment 28 to automatically deploy. The lower cushion support bar is secured to the bottom of the carrying cushion 98, such that the bottom of the carrying cushion 98 remains substantially straight.

In one embodiment, an intermediate cushion support bar traverses from the first lower arm 74 to the second lower arm 76 of the lower support 24. The intermediate cushion support bar is secured to an intermediate portion between two cushion segments 100 of the carrying cushion 98 to displace the cushion 98 substantially at the aforementioned second angle while the backpack assembly 10 is in the sitting position.

In one embodiment, an upper cushion support bar traverses between the first upper arm 58 and the second upper arm 60. The upper cushion support bar is secured to an upper portion of the carrying cushion 98 and/or to the flexible sheet 26. In some embodiments, the carrying cushion 98 and the flexible sheet 26 are a single continuous component.

Embodiments of the invention comprise the roller segment 28. The roller segment 28 allows the backpack assembly 10 to be easily moved by the user without having to lift the backpack assembly 10. The roller segment 28 comprises two roller arms 104, two rollers 106, and two lower-support attachment points 108. Each roller arm 104 presents a distal end 110 and a proximal end 112. A roller interface is disposed at the distal end 110 of each roller arm 104 for rotatably securing the roller 106. The lower-support attachment point 108 is disposed at the proximal end of each roller arm 104.

The roller segment 28 of some embodiments is selectively positionable in an engaged position (as illustrated in FIGS. 7 and 8) and a stored position (as illustrated in FIG. 1-6). When in the engaged position, the roller arm 104 is rotated downward about the lower-support attachment points 108. This allows the roller 106 of the roller segment 28 to be in contact with the ground. When in the stored position, the roller arm 104 is rotated upward about the lower-support attachment points 108. This prevents the roller 106 of the roller segment 28 from being in contact with the ground, such that the roller 106 will not destabilize the foldable seat 20.

In embodiments of the invention, the roller segment 28 is automatically positioned into the engaged position and the stored position by the cushion support bars. When the backpack assembly 10 is in the carrying position, the roller segment 28 is in the engaged position. When the backpack assembly 10 is in the sitting position, the roller segment 28 is in the stored position. As the user alters the position of the backpack assembly 10, the aforementioned second angle (between the upper support 22 and lower support 24, as discussed above) changes. Each end of the lower cushion support bars is rotatably attached to the distal end 110 of the respective roller arm 104. Two engaging bars 114 are rotatably secured to distal end 110 of the respective roller arms 104. The two engaging bars 114 are also rotatably secured to the intermediate cushion support bar at a location other the location in which the lower support 24 is rotatably secured to the upper support 22. As the second angle changes, the engaging bars 114 push or pull the distal end 110 of the roller arm 104 away from or toward the ground.

In other embodiments, the roller segment 28 is selectively placed in the engaged and stored positions by the user independent of the position of the backpack assembly 10. In yet other embodiments, the roller segment 28 is not selectively interchangeable between positions. The roller 106 of the roller segment 28 of these embodiments may be in contact with the ground so long as the backpack assembly 10 is in contact with the ground. In some embodiments the rollers 106 of the roller segment 28 are ruggedized and adapted to travel over rough terrain, by, for example, presenting a tread, having a larger diameter, and being formed of a cushioning polymer.

In some embodiments of the invention, the backpack 12 includes the telescoping handle 32, as best illustrated in FIG. 8. The telescoping handle 32 presents a proximal end 116 and a distal end 118. The telescoping handle 32 is formed of a handgrip 120 disposed at the distal end 118 and a plurality of elongated segments. The elongated segments of the plurality are successively disposed within each other. The telescoping handle 32 extends out of and retracts into the at least a portion of the backpack 12. When the telescoping handle 32 is in a retracted position, with the plurality of elongated segments substantially within each other, it is stored, as discussed below. When the telescoping handle 32 is in an extended position, it is adapted to be held by the user via the handgrip 120. The telescoping handle 32 extends in an substantially vertical upward direction from the backpack 12. The telescoping handle 32 is secured at the proximal end 116 to the backpack 12. In some embodiments, as illustrated in FIG. 8, the telescoping handle 32 is substantially T-shaped, with the handgrip 120 disposed horizontally at the distal end 118 of the telescoping handle (which is oriented vertically). In other embodiments, not illustrated, the telescoping handle is substantially an upside-down U-shape, with the handgrip 120 disposed at the distal end 118 of two substantially parallel telescoping handles.

In some embodiments of the invention, the telescoping handle 32 is stored within a handle opening (not illustrated) in the backpack 12. The handle opening is located in the top segment of the backpack 12, such that the telescoping handle 32 may extend out of and retract into the backpack 12, as discussed above. The handle opening may be secured via one of the structures discussed above or an equivalent. The handgrip 120 may retract within the handle opening, or remain atop the top segment of the back, when the telescoping handle 32 is in the retracted position.

The telescoping handle 32 may lock into the extended position, lock in the retracted position, or both. The handgrip 120 may present a release button (not illustrated) for unlocking the lock. With the telescoping handle 32 locked it the extended position, the user tips the telescoping handle 32 away from the substantially vertical upward direction and in a backward direction. In this tilted position, the weight of the backpack assembly 10 is on the at least one roller 106. The user can then pull or push the backpack assembly 10.

In some embodiments of the invention, the bag frame 16 further comprises two retaining clips 122 to retain the backpack assembly 10 in the carrying position. The retaining clips 122 extend from the bag frame 16 backward toward the foldable seat 20. The retaining clips 122 present an interior shape that is complementary to a cross-sectional shape of the upper support 22 and/or the lower support 24. In one embodiment, the retaining clip 122 is C-shaped and the upper support 22 and/or lower support 24 presents a circular shape at cross-section. As the user places the backpack assembly 10 into the carrying position, the user presses (either directly or indirectly) the upper support 22 and/or lower support 24 into the opening of the C-shaped retaining clip 122, deforming the C-shape slightly to allow the support to pass through the opening. The retaining clip 122 then remains around the upper support 22 and/or lower support 24, and therefore the backpack assembly 10 remains in the carrying position, until physically pulled away by the user.

In some embodiments of the invention, the lower support 24 further comprises two flexible strap retainers 124 to prevent the tangling of the flexible strap 18 in the foldable seat 20 during repeated alterations between the two positions. The flexible strap retainer 124 includes two anchor points and at least one expandable string disposed therebetween. Each flexible strap 18 runs under the respective flexible strap retainer 124. The flexible strap 18 is disposed beneath at least one expandable string (i.e., between the expandable string and the lower support 24), for example, by detaching the center of the flexible strap as described above. The flexible strap retainers 124 of one embodiment are optional for use by the user.

While already discussed throughout, a method of using the backpack assembly 10 will now be given more detail for clarity. The user can manipulate the backpack assembly 10 to be in either of two positions. In the carrying position (as illustrated in FIGS. 7-8), the foldable seat 20 is folded and substantially adjacent to the bag frame 16. The retaining clips 122 keep the backpack assembly 10 in the carrying position. In the carrying position, the user can place the pair of flexible straps 18 around each of the user's respective shoulders. The user can then transport the backpack assembly 10 to various locations without having to hold the foldable seat 20 or the contents of the compressible bag 14 in the user's hand. Upon removing it from the user's shoulders, the backpack assembly 10 sits vertically and stably on the ground due to the substantially rigid bottom that is secured to the bad frame. When it is vertically sitting on the ground, the user can manipulate the backpack assembly 10 into the seated position (as illustrated in FIGS. 1-6) by pulling the upper support 22 and/or lower support 24 out of the retaining clips 122 or otherwise releasing a lock mechanism. The user then continues to pull in one simple motion until the flexible sheet 26 becomes substantially taut and the foldable seat 20 is in the substantial K-shaped configuration discussed above. The user may then sit upon the flexible sheet 26 of the foldable seat 20. The user may also, regardless of the position of the backpack assembly 10, place items into and remove items from the compressible bad via the openings discussed above.

In other embodiments of the invention, not illustrated, the backpack assembly 10 comprises a frameless backpack and the foldable seat 20. In these embodiments, when the backpack assembly 10 is in the carrying position, the upper and lower supports 22, 24 act as the bag frame for the comfort of the user. When the backpack assembly 10 is in the sitting position, the foldable seat 20 may utilize a securable traversing support (not illustrated) to keep the supports in a stable deployed configuration.

In other embodiments of the invention, not illustrated, the backpack assembly 10 comprises the bag frame 16 and the foldable seat 20. In these embodiments, there is no backpack or compressible bag supplied with the backpack assembly 10. Instead, the user is invited or instructed to secure a backpack that the user already owns (or concurrently purchases) to the backpack assembly 10. In this manner, the backpack assembly 10 can add the features described herein to any existing backpack for increased versatility and customization. The bag frame 16 of these embodiments may provide straps, clips, or other attachment points for securing the bag frame 16 to the user's backpack. In some embodiments of the invention, the backpack 12 is provided but is detachable from the bag frame 16. For example, the customer may purchase the bag frame 16 and the foldable seat 20 along with a soccer-specific backpack 12. The user then assembles the backpack 12 onto the bag frame 16 and foldable seat 20.

Although embodiments of the invention have been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A backpack assembly comprising:

a backpack having a rigid bag frame; and an integrated seat, including:

an upper support presenting a proximal end and a distal end, wherein the proximal end of the upper support is pivotably secured to the bag frame;

a lower support that presents a proximal end and a distal end, wherein the proximal end of the lower support is pivotably secured to the upper support between the proximal end and the distal end of the upper support, wherein the distal end of the lower support is configured to contact the ground while the integrated seat is in a sitting position; and a flexible sheet supported by the backpack and the upper support, wherein the flexible sheet is configured to receive the user sitting thereon while the backpack assembly is in the sitting position, wherein the bag frame, the upper support, and the lower support present a general K-shape when viewed from a side while the integrated seat is in the sitting position.

2. The backpack assembly of claim 1, wherein the bag frame, the upper support, and the lower support are substantially parallel and adjacent while the integrated seat is in a carrying position.

3. The backpack assembly of claim 1, wherein the upper support comprises:

a first upper arm that terminates at a first upper-support interface of the bag frame;

a second upper arm that terminates at a second upper-support interface of the bag frame; and an upper traversing segment disposed between the first upper arm and the second upper arm.

4. The backpack assembly of claim 3, wherein the first upper-support interface and the second upper-support interface are each disposed on the bag frame between an upper end of the bag frame and a lower end of the bag frame.

5. The backpack assembly of claim 3, wherein the lower support comprises:

a first lower arm that terminates at a lower-support interface of the first upper arm;

a second lower arm that terminates at a second lower-support interface of the second upper arm; and a lower traversing segment disposed between the first lower arm and the second lower arm.

6. The backpack assembly of claim 5, wherein the first lower-support interface is disposed on the first upper arm in an intermediate segment of the first upper arm, wherein the second lower-support interface is disposed on the second upper arm in an intermediate segment of the second upper arm.

7. A seat configured to be added to a backpack having a bag frame, the seat comprising:

an upper support presenting a proximal end and a distal end, wherein the proximal end of the upper support is pivotably secured to the bag frame;

a lower support that presents a proximal end and a distal end, wherein the proximal end of the lower support is pivotably secured to the upper support between the proximal end and the distal end of the upper support, wherein the distal end of the lower support is configured to contact the ground while the integrated seat is in a sitting position; and a flexible sheet supported by the backpack and the upper support, wherein the flexible sheet is configured to receive the user sitting thereon while the backpack assembly is in the sitting position, wherein the bag frame, the upper support, and the lower support present a general K-shape when viewed from a side while the integrated seat is in the sitting position.

8. The seat of claim 7, wherein the bag frame, the upper support, and the lower support are substantially parallel and adjacent while the integrated seat is in a carrying position.

9. The seat of claim 7, wherein the upper support comprises:

a first upper arm that terminates at a first upper-support interface of the bag frame;

a second upper arm that terminates at a second upper-support interface of the bag frame; and an upper traversing segment disposed between the first upper arm and the second upper arm.

10. The seat of claim 9, wherein the first upper-support interface and the second upper-support interface are each disposed on the bag frame between an upper end of the bag frame and a lower end of the bag frame.

11. The seat of claim 9, wherein the lower support comprises:

a first lower arm that terminates at a lower-support interface of the first upper arm;

a second lower arm that terminates at a second lower-support interface of the second upper arm; and a lower traversing segment disposed between the first lower arm and the second lower arm.

12. The seat of claim 11, wherein the first lower-support interface is disposed on the first upper arm in an intermediate segment of the first upper arm, wherein the second lower-support interface is disposed on the second upper arm in an intermediate segment of the second upper arm.

13. A backpack assembly configured to be selectively placed into a carrying position and sitting position, the backpack assembly comprising:

a backpack having a rigid bag frame; and an integrated seat, including:

an upper support pivotably terminating at the bag frame, wherein the upper support is disposed at a first angle relative to the bag frame while the backpack assembly is in the sitting position, wherein the upper support is substantially parallel to the bag frame while the backpack assembly is in the carrying position;

a lower support pivotably terminating at the upper support, wherein the lower support is disposed at a second angle relative to the upper support while the backpack assembly is in the sitting position, wherein the lower support is substantially parallel to the bag frame while the backpack assembly is in the carrying position; and a flexible sheet supported by the backpack and the upper support, wherein the flexible sheet is configured to support a user sitting thereon while the backpack assembly is in the sitting position, wherein the bag frame, the upper support, and the lower support present a general K-shape when viewed from a side while the integrated seat is in the sitting position.

14. The backpack assembly of claim 13, wherein the first angle is in a range of ten to eighty degrees, wherein the second angle is in a range from sixty to one hundred and twenty degrees.

15. The backpack assembly of claim 13, wherein the first angle is in a range of thirty to sixty degrees, wherein the second angle is in a range from eighty to one hundred degrees.

16. The backpack assembly of claim 13, wherein the bag frame, the upper support, and the lower support present a general K-shape when viewed from a side while the integrated seat is in the sitting position.

17. The backpack assembly of claim 13, wherein the first angle is substantially different than the second angle while the backpack assembly is in the sitting position.

* * * * *